US010454173B2

(12) United States Patent
Taachouche et al.

(10) Patent No.: US 10,454,173 B2
(45) Date of Patent: Oct. 22, 2019

(54) FREQUENCY-TUNABLE AND SLOT-FED PLANAR ANTENNA, AND SATELLITE-BASED POSITIONING RECEIVER COMPRISING SUCH AN ANTENNA

(71) Applicants: Universite De Rennes 1, Rennes (FR); CNRS—Centre National de la Recherche Scientifique, Paris (FR)

(72) Inventors: Yaakoub Taachouche, Rennes (FR); Mohamed Himdi, Rennes (FR)

(73) Assignees: UNIVERSITE DE RENNES 1, Rennes (FR); CNRS—CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 27 days.

(21) Appl. No.: 15/127,579

(22) PCT Filed: Mar. 17, 2015

(86) PCT No.: PCT/EP2015/055484

§ 371 (c)(1),
(2) Date: Sep. 20, 2016

(87) PCT Pub. No.: WO2015/140127

PCT Pub. Date: Sep. 24, 2015

(65) Prior Publication Data

US 2017/0141471 A1 May 18, 2017

(30) Foreign Application Priority Data

Mar. 20, 2014 (FR) ..... 14 52301

(51) Int. Cl.

| | |
|---|---|
| ***H01Q 9/04*** | (2006.01) |
| ***H01Q 9/14*** | (2006.01) |
| ***H01Q 5/50*** | (2015.01) |
| ***H01Q 1/38*** | (2006.01) |

(Continued)

(52) U.S. Cl.
CPC ..... *H01Q 9/0407* (2013.01); *H01Q 1/288* (2013.01); *H01Q 1/38* (2013.01); *H01Q 1/48* (2013.01);

(Continued)

(58) Field of Classification Search
CPC ..... H01Q 9/0407–0457
See application file for complete search history.

(56) References Cited

U.S. PATENT DOCUMENTS

| | | | |
|---|---|---|---|
| 6,191,740 | B1 | 2/2001 | Kates et al. |
| 2010/0073238 | A1 | 3/2010 | Jun et al. |

FOREIGN PATENT DOCUMENTS

| | | | |
|---|---|---|---|
| JP | H01252002 | A | 10/1989 |
| WO | 2007006773 | A1 | 1/2007 |

OTHER PUBLICATIONS

R. Caso, A. Serra, A. Buffi, M. Rodriguez-Pino, P. Nepa and G. Manara, "Dual-polarised slot-coupled patch antenna excited by a square ring slot," in IET Microwaves, Antennas & Propagation, vol. 5, No. 5, pp. 605-610, Apr. 2011.*

(Continued)

*Primary Examiner* — Jessica Han
*Assistant Examiner* — Amal Patel
(74) *Attorney, Agent, or Firm* — David D. Brush; Westman, Champlin & Koehler, P.A.

(57) ABSTRACT

A Frequency-tunable and slot-fed planar antenna is proposed. The antenna includes resonant patch, a first dielectric layer, a ground plane having a first slot for each linear polarization, a second dielectric layer and a transmission line having, for each first slot, an end strand extending beneath the first slot. The antenna is frequency tunable for each linear polarization through at least one variable capacitance element. The matching of the antenna varies, for each linear polarization, as a function of a bias voltage applied to the (Continued)

variable capacitance element(s). The antenna includes, for each linear polarization, at least one second slot extending along the first slot. The end strand of the transmission line extends between the first slot and second slots. The at least one second slot creates an additional resonance.

7 Claims, 8 Drawing Sheets

(51) Int. Cl.
*H01Q 3/22* (2006.01)
*H01Q 1/28* (2006.01)
*H01Q 1/48* (2006.01)

(52) U.S. Cl.
CPC ..... *H01Q 3/22* (2013.01); *H01Q 5/50* (2015.01); *H01Q 9/0435* (2013.01); *H01Q 9/0442* (2013.01); *H01Q 9/0457* (2013.01); *H01Q 9/0464* (2013.01); *H01Q 9/145* (2013.01)

(56) References Cited

OTHER PUBLICATIONS

International Preliminary Report on Patentability and English translation of the Written Opinion of the International Searching Authority dated Sep. 20, 2016, for corresponding International Application No. PCT/EP2015/055484, filed Mar. 17, 2015.

International Search Report dated May 19, 2015, for corresponding International Application No. PCT/EP2015/055484, filed Mar. 17, 2015.

Mariusz Pergol et al: "Broadband microstrip patch antenna with reduced transversal size", Microwave Radar and Wireless Communications (MIKON), 2010 18th International Conference On, IEEE, Piscataway, NJ, USA, Jun. 14, 2010 (Jun. 14, 2010), pp. 1-3, XP031726099.

Le Ray G et al: "Frequency agile slot-fed patch antenna", Electronics Letters, IEE Stevenage, GB, vol. 1 32, No. 1, Jan. 4, 1996 (Jan. 4, 1996), pp. 2-3, XP006004551.

Murakami Y et al: "Mutual Coupling Between Two Ports of Dual Slot-Coupled Circular Patch Antennas", Proceedings of the Antennas and Propagation Society International Symposium (APSIS), Ann Arbor, June 28-July 2. 1993; [Proceedings of the Antennas and Propagation Society International Symposium (APSIS)], New York, IEEE, US, vol. 3, Jun. 28, 1993 (Jun. 28, 1993), pp. 1469-1472, XP000452549.

Written Opinion of the International Searching Authority dated May 19, 2015, for corresponding International Application No. PCT/EP2015/055484, filed Mar. 17, 2015.

Zhang et al. "Compact Broad-Band Annular Ring Antenna for Global Navigation Satellite Systems." 9th International Symposium on Antennas Propagation and Em Theory, pp. 189-192. Nov. 29, 2010-Dec. 2, 2010.

* cited by examiner

FREQUENCY-TUNABLE AND SLOT-FED PLANAR ANTENNA, AND SATELLITE-BASED POSITIONING RECEIVER COMPRISING SUCH AN ANTENNA

1. CROSS-REFERENCE TO RELATED APPLICATIONS

This application is a Section 371 National Stage Application of International Application No. PCT/EP2015/055484, filed Mar. 17, 2015, the content of which is incorporated herein by reference in its entirety, and published as WO 2015/140127 on Sep. 24, 2015, not in English.

2. FIELD OF THE INVENTION

The field of the invention is that of antennas.

More specifically, the invention relates to a frequency-tunable, slot-fed planar antenna.

The invention has numerous applications, as for example, in a satellite positioning receiver used to receive and process signals coming from different global navigation satellite systems.

3. TECHNOLOGICAL BACKGROUND

Many countries have set up (or are soon going to set up) satellite constellations dedicated to localization in the GNSS (1.16 to 2.5 GHz) band. There are different GNSS systems, among them:

the GPS system for the USA
the GALILEO system for Europe
the GLONASS system for Russia
the COMPASS system for China, and
the IRNSS system for India.

The GPS, GALILEO, GLONASS and COMPASS systems use frequencies ranging from the 1.164 to the 1.1602 GHz bands. By contrast, the IRNSS system uses frequencies in the band around 2.49 GHz.

The spectrum of frequencies used by the GNSS system is very broad. The antennas must therefore be capable of efficiently picking up signals from the different constellations in the band ranging from 1.16 to 2.5 GHz (more than one octave) with circular polarization and a directional radiation pattern.

The literature on the subject often refers to two types of antennas:

- dual-band antennas to cover two bands (one band from 1.16 to 1.3 GHz and the other band from 1.55 to 1.61 GHz (see for example the patent document WO2007006773 entitled "Antenna multibandes pour système de positionnement par satellite" (Multi-band antenna for satellite positioning system); and
- broadband antennas which generally cover the entire 1.16 to 1.61 GHz band (see for example Hong-Lin Zhang, Xiu-Yin Zhang, Bin-Jie Hu, "Compact broad-band annular ring antenna for global navigation satellite systems, 9th International Symposium on Antennas Propagation and EM Theory, Vol., No., pp. 189, 192, 29 Nov. 2010-2 Dec. 2010).

One drawback of these two types of known antennas is that they do not cover the 2.5 GHz band. In other words, they do not cover the entire GNSS band (1.16 to 2.5 GHz).

There is also a third known type of antenna, namely antennas that are narrow-band antennas but are tunable on a very wide frequency band.

FIGS. 1A, 2A and 2B illustrate an example of an antenna of this third type, namely a slot-fed and frequency-tunable planar antenna 1. FIG. 1A is a three-quarter view, FIG. 2A is a top view and FIG. 2B is a view in section. This is an association between a planar antenna (also called a patch antenna) that is slot-fed and two variable capacitance elements 7 (in this example variable capacitance diodes also called varicap diodes). These diodes enable the antenna to be made tunable over a wide band of frequencies.

The slot-fed planar antenna possesses a structure in which the following are superimposed successively:

- a resonant patch 1
- a first dielectric layer 2 (for example consisting of air or a dielectric substrate)
- a ground plane 3 comprising a slot 4 (operating according to single linear polarization in this example)
- a second dielectric layer 5 (for example air or a dielectric substrate) and
- a transmission line 6 (also called a feed line even if the antenna is used in reception) comprising an end strand extending beneath the slot.

In the particular implementation illustrated, the first dielectric layer 2 is a layer of dielectric material with a thickness t and permittivity $\in_{r1}$, on the upper face of which the resonant patch 1 is printed. The second dielectric layer 5 is a layer of dielectric material with a thickness h and permittivity $\in_{r2}$, on the upper face of which there is printed the ground plane 3 (comprising the slot 6) and on the lower face of which there is printed the transmission line 6 (represented in dashes) and a continuous polarization line (used to convey the bias voltage to the resonant patch 1 which is itself connected to the variable capacitance elements 7).

Each variable capacitance element (varicap diode) is connected between a radiating side of the resonant patch 1 and the ground plane 3. The matching of the antenna varies according to a bias voltage applied to the variable capacitance elements.

FIG. 1B presents six curves illustrating the variation of the reflection coefficient $S_{11}$ as a function of the frequency for different values of the bias voltage of the varicap diodes. Each curve corresponds to a distinct resonance and is obtained from one of the values of the bias voltage (0V, 4V, 8V, 12V, 16V and 22V). The matching of the antenna varies according to the bias voltage of the diode. The frequency of operation of the antenna varies between 1.7 GHz and 2.4 GHz, for a bias voltage that varies between 0 and 22V. This antenna is therefore tunable on a wide band of frequencies.

One major drawback of this antenna is that this tunability over a wide band of frequencies requires the use of very high bias voltage values which exceed 20V.

4. SUMMARY OF THE INVENTION

One particular embodiment of the invention proposes a frequency-tunable and slot-fed planar antenna possessing a structure in which there are successively superimposed a resonant patch, a first dielectric layer, a ground plane comprising a first slot for each linear polarization, a second dielectric layer and a transmission line comprising, for each first slot, an end strand extending beneath said first slot, said antenna being frequency tunable for each linear polarization through at least one variable capacitance element connected between a radiating side of the resonant patch and the ground plane, the matching of said antenna varying for each linear polarization as a function of a bias voltage applied to said at least one variable capacitance element. The antenna comprises, for each linear polarization, at least one second slot extending along the first slot and having at least one dimension different from the first slot, said end strand of the transmission line extending beneath said first slot and said at least one second slot, said first slot creating a first resonance and said at least one second slot creating an additional resonance. The antenna has a frequency tunability resulting, for each linear polarization, from said first resonance for at least one first value of the bias voltage, and from said additional resonance for at least one second value of the bias voltage.

The general principle of the invention therefore consists, for each linear polarization, in using not one but several (two or more) slots fed in series by a same end strand of the transmission line. Thus, while providing a compact solution with interaction between the slots (since they are fed in series), each additional slot (i.e. each slot other than the first one) creates another resonance. Compared with the known solution illustrated in FIG. 1B, the present solution enables an increase in the number of resonances with a limited range of variation of the bias voltage. Thus, to tune the antenna into a given frequency band, there is need for a bias voltage that varies in a smaller range (for example 0V to 5V and preferably 0V to 3V) than the range of variation in present-day solutions (0V to 20V or more).

According to one particular characteristic, for each linear polarization, said at least one second slot and said first slot are of the same shape.

According to one particular characteristic, for each linear polarization, said at least one second slot and said first slot possess parallel longitudinal axes.

According to one particular characteristic, said bias voltage varies between 0V to 5V.

Thus, a low bias voltage is used, compatible with the voltages available on the portable devices.

According to one particular characteristic, for a first value of the bias voltage, the antenna covers a first sub-band resulting from the first resonance created by the first slot and for a plurality of second successive values of the bias voltage, the antenna covers a plurality of second successive sub-bands distinct from the first sub-band, and each resulting from the additional resonance created by said at least one second slot.

Because all the sub-bands are not covered by resonances resulting from the same slot, the antenna is tunable over a plurality of sub-bands with a lower range of variation of the bias voltage.

According to one particular characteristic, the first sub-band is around 2.5 GHz and the plurality of successive second sub-bands form a band ranging from 1.1 GHz to 1.6 GHz.

Thus, the antenna covers (i.e. is tunable in) the entire GNSS frequency band (including the frequencies around 2.5 GHz). In this GNSS frequency band, it enables the selection of a sub-band (i.e. the reception band of one constellation) by efficiently and naturally filtering out the other sub-bands (i.e. the reception bands of the other constellations).

According to one particular characteristic, the first value is 0V and the plurality of second successive values are between 1.5V to 3V.

Thus, the proposed antenna requires a lower bias voltage than in present-day solutions.

According to one particular implementation, the resonant patch is square shaped with a side length $l_p$ equal to 55 mm±1 mm, and for each linear polarization:

said first slot is rectangular with a length $l_3$ equal to a 40 mm±1 mm and a width $w_3$ equal to 1 mm±0.1 mm; and said at least one second slot is rectangular, with a length $l_2$ equal to 30 mm±1 mm and a width $w_2$ equal to 2 mm±0.1 mm.

In this particular implementation, the antenna costs little, and is compact and tunable in the entire GNSS frequency band (including around 2.5 GHz).

In a first implementation, the antenna works according to a single linear polarization.

In a second implementation, the antenna works according to first and second orthogonal linear polarizations, the combination of which gives a circular polarization, and the first slot and said at least one second slot for the first linear polarization are orthogonal respectively to the first slot and said at least one second slot for the second linear polarization.

Thus, the antenna works with a circular polarization which corresponds to the one currently used by global navigation satellite systems (GNSS).

One particular embodiment of the invention proposes a satellite positioning receiver enabling the reception and processing of signals coming from different satellite positioning systems, this receiver comprising or cooperating with an antenna according to any one of the embodiments described here below.

5. LIST OF FIGURES

Other features and advantages of the invention shall appear from the following description given by way of an indicative and non-exhaustive example, and from the appended drawings of which:

FIGS. 1A, 1B, 2A and 2B, already described with reference to the prior art, illustrate the structure and performance of an example of a slot-fed and frequency-tunable antenna according to the prior art;

6. DETAILED DESCRIPTION

In all the figures of the present document, the identical elements are designated by a same numerical reference.

Referring now to FIGS. 3A, 3B, 4A and 4B, we present an antenna 30 according to a first particular embodiment of the invention, working according to a single linear polarization.

Figure 1A:
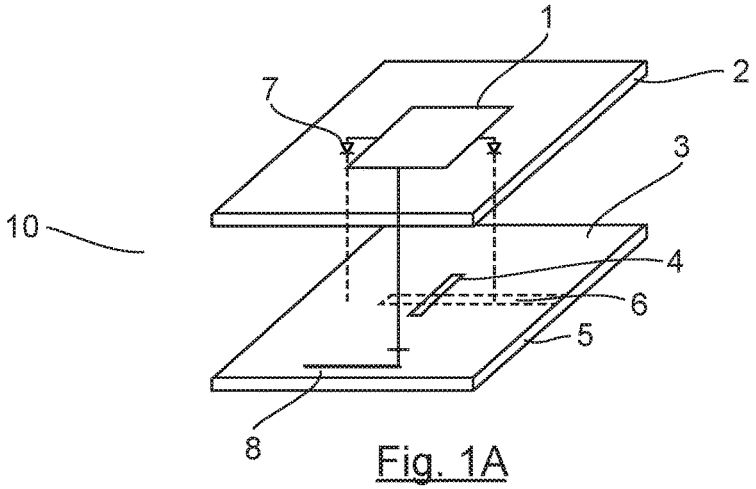
Fig. 1A (Prior Art)
Figure 1B:
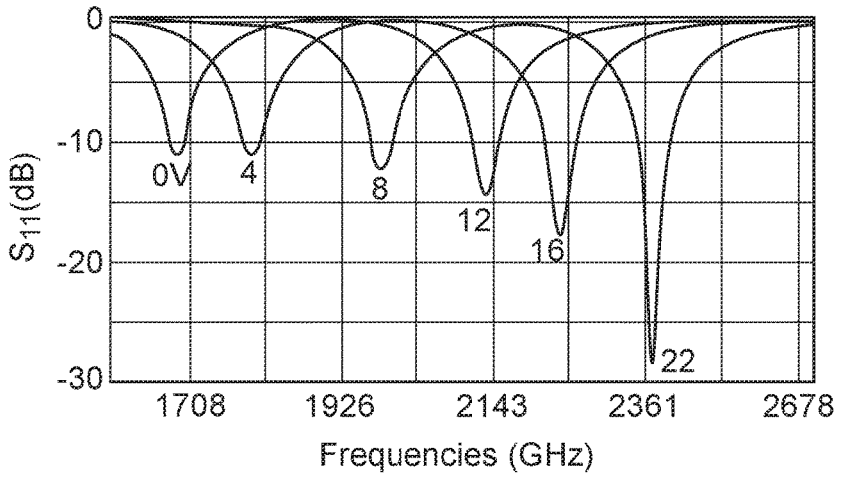
Fig. 1B (Prior Art)
Figure 2A:
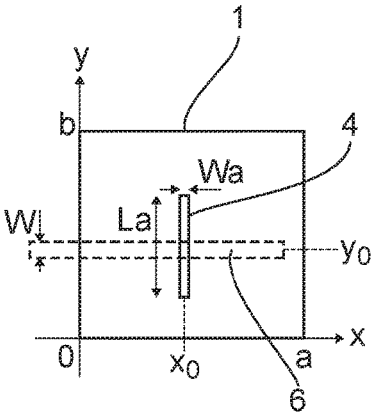
Fig. 2A (Prior Art)
Figure 2B:
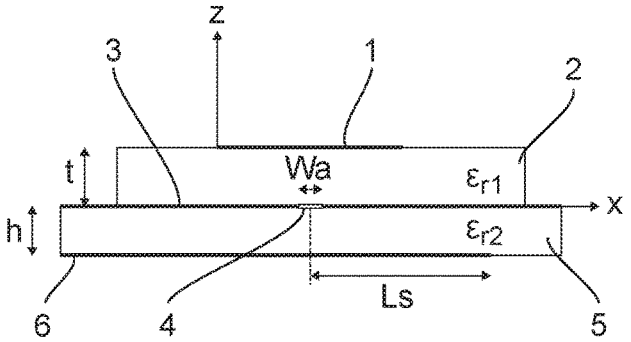
Fig. 2B (Prior Art)

Purely for the sake of simplification, the top views (FIGS. 3A and 3B) and the views in section (4A and 4B) are partial views. These figures do not show the variable capacitance elements (for example varicap diodes) which make the antenna 30 tunable over a wide band of frequencies. As in the prior art technique illustrated in FIG. 1A, the antenna 30 comprises for example, a variable capacitance element (varicap diode) connected between each radiating side of the resonant patch and the ground plane.

The antenna 30 possesses a structure in which the following are super-imposed in succession:

- a resonant patch 31;
- a first dielectric layer 32 (for example air or a dielectric substrate);
- a ground plane 33, comprising first and second slots 34A, 34B (working according to a single linear polarization in this example);
- a second dialectic layer 35 (for example air or a dielectric substrate); and
- a transmission line 36 comprising an end strand extending beneath the two slots 34*a*, 35*b*.

Figure 8:
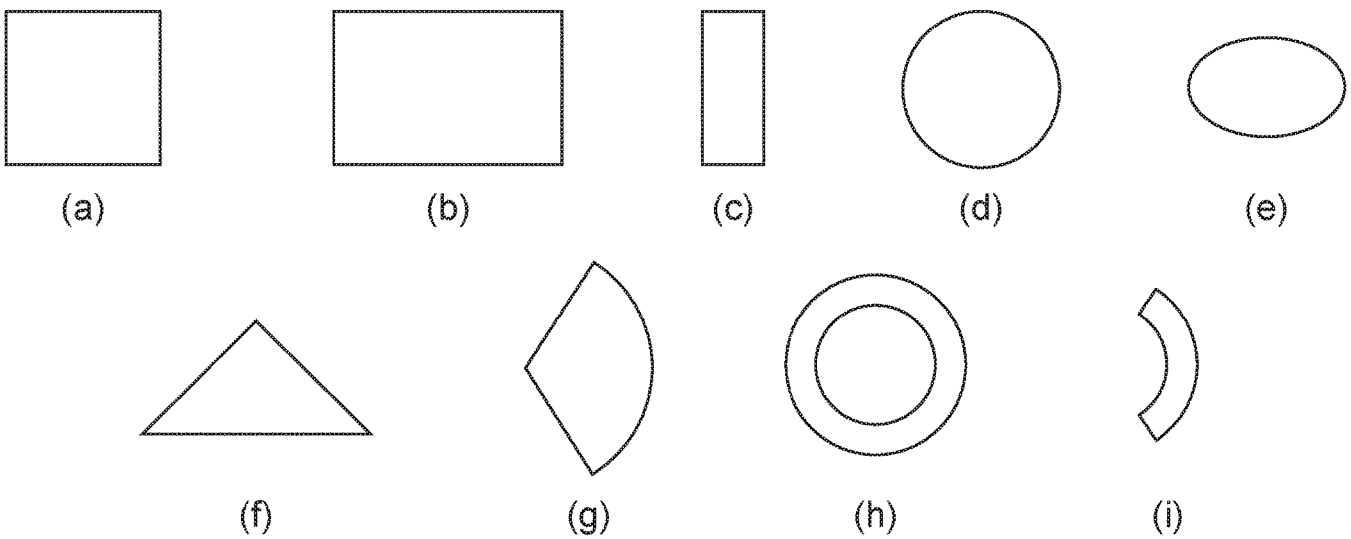
FIG. 8 illustrates various possible shapes for the resonant patch of the antennas according to the invention.

In this example, the resonant patch 31 is square shaped. However, it is possible to use different shapes of patches and especially but not exclusively the shapes illustrated in FIG. 8 ((a) square shape (b) rectangular (c) dipole (d) circular (e) elliptical (f) triangular (g) disk sector (h) circular ring (i) ring sector).

Figure 7:
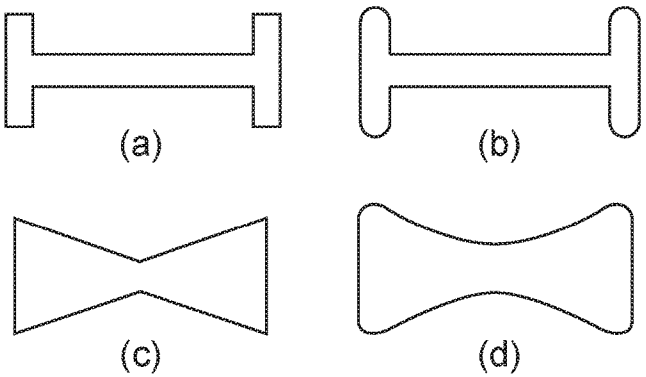
FIG. 7 illustrates various possible shapes for the slots of the antenna according to the invention.

The second slot 3*b* extends along the first slot 34*a*. These slots differ in at least one dimension. In this example, the two slots 34*a*, 34*b* have the same shape, namely rectangular, and have parallel longitudinal axes. It is however possible to use other shapes of slot and especially but not exclusively the shapes illustrated in FIG. 7 ((a) (H) dog bone (c) bowtie (d) hourglass).

Figure 3A:
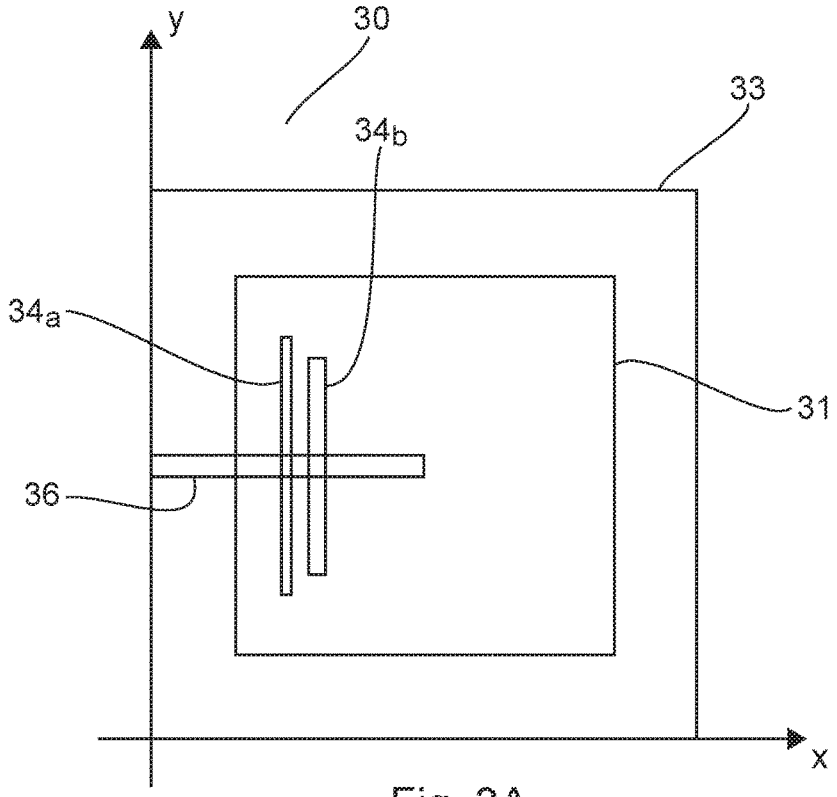
FIGS. 3A and 3B are top views respectively presenting the structure and dimensions of an antenna according to a first particular embodiment of the invention, working according to a single linear polarization.
Figure 3B:
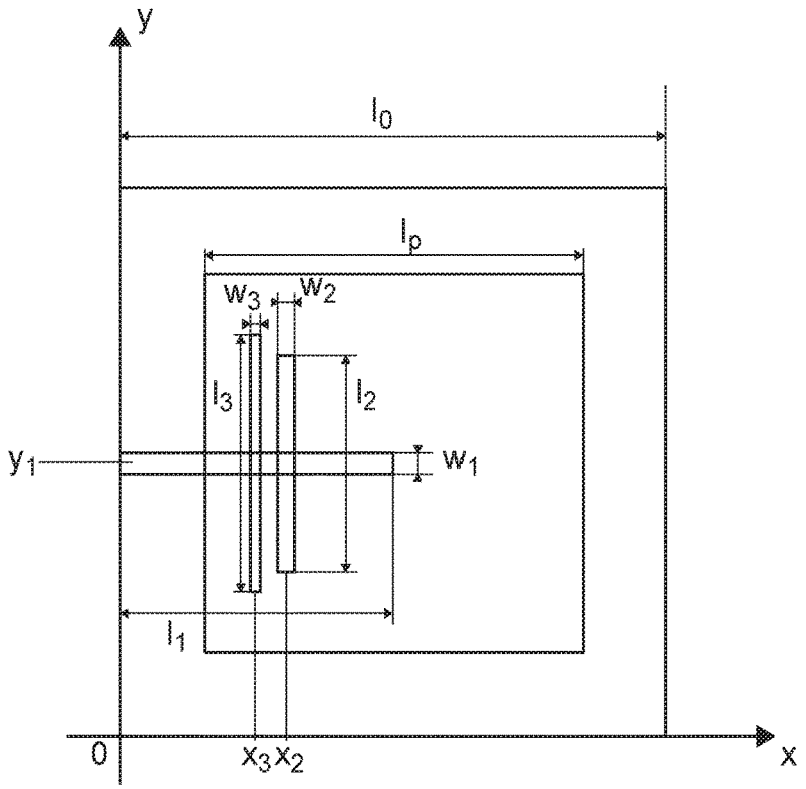
Figure 4A:
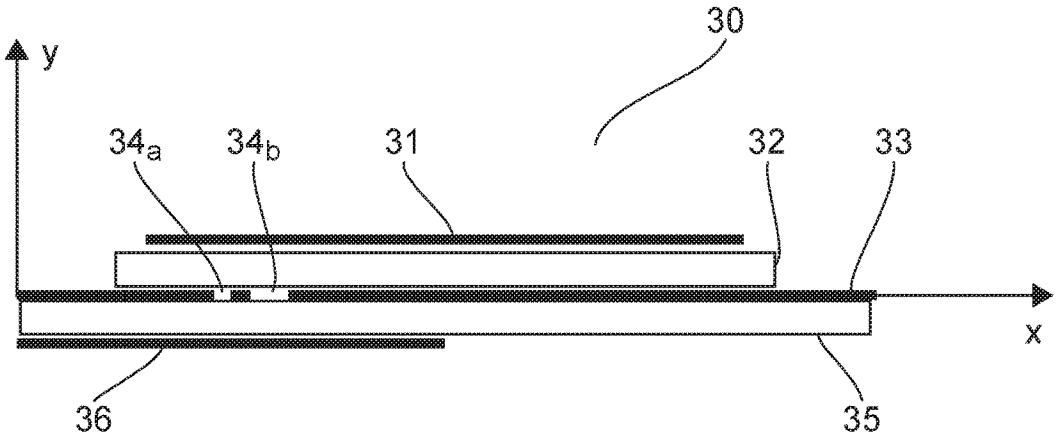
FIGS. 4A and 4B are views in section presenting respectively the structure and the dimensions of an antenna according to said first particular embodiment of the invention, working according to a single linear polarization.
Figure 4B:
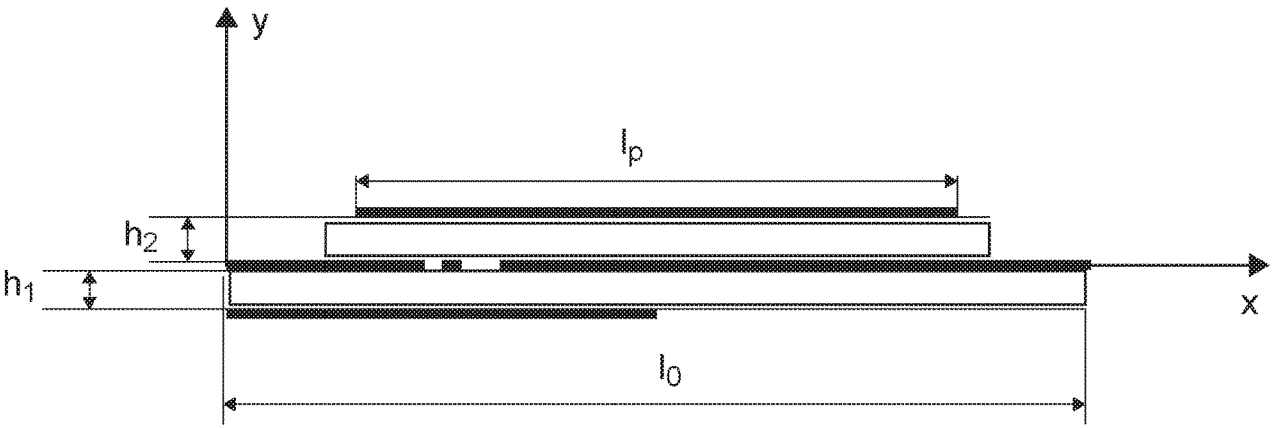

As indicated in FIGS. 3B and 4B, the antenna is defined by the following dimensions:

- for the square-shaped resonant patch 31, the length $l_p$ of the sides;
- for the first dielectric layer 32, thickness $h_2$ and permittivity for the first layer of dielectric 32, thickness $h_2$ and permittivity and $\in_{r2}$;
- for the square-shaped ground plane 33, the length $l_0$ of the sides;
- for the first rectangular slot 34*a* the length $l_3$ and the width $w_3$, as well as the abscissa value $x_3$ (corresponding to the point obtained by orthogonal projection along the longitudinal axis of the first slot) in a referential system centered on the lower left-hand corner of the ground plane 33;
- for the second rectangular slot 34*b* the length $l_2$ and the width $w_2$, as well as the abscissa value $x_2$ (corresponding to the point obtained by orthogonal projection along the longitudinal axis of the second slot) in the above-mentioned reference mark;
- for the second dielectric layer 35, thickness $h_1$ and permittivity $\in_{r1}$;
- for the transmission line 36, the length $l_1$, the width $w_1$, the ordinate value $y_1$ in the above-mentioned referential system.

In one particular embodiment, the antenna 30 possesses the following dimensions:

| | | | |
|---|---|---|---|
| $l_0$ = 105 m**m ± 1 mm | $l_p$ = 55 mm ± 1 mm | $h_1$ = 0.8 mm ± 0.01 mm | $h_2$ = 6 mm ± 0.5 mm |

-continued

| | | | |
|---|---|---|---|
| $l_2$ = 30 mm ± 1 mm | $w_2$ = 2 mm ± 0.1 mm | $l_3$ = 40 mm ± 1 mm | $w_3$ = 1 mm ± 0.1 mm |
| $w_1$ = 2 mm ± 0.5 mm | $x_2$ = 34.5 mm ± 0.5 mm | $x_3$ = 26 mm ± 0.5 mm | $l_1$ = 60 mm ± 1 mm |
| $y_1$ = 52.5 mm ± 1 mm | | | |

Figure 5:
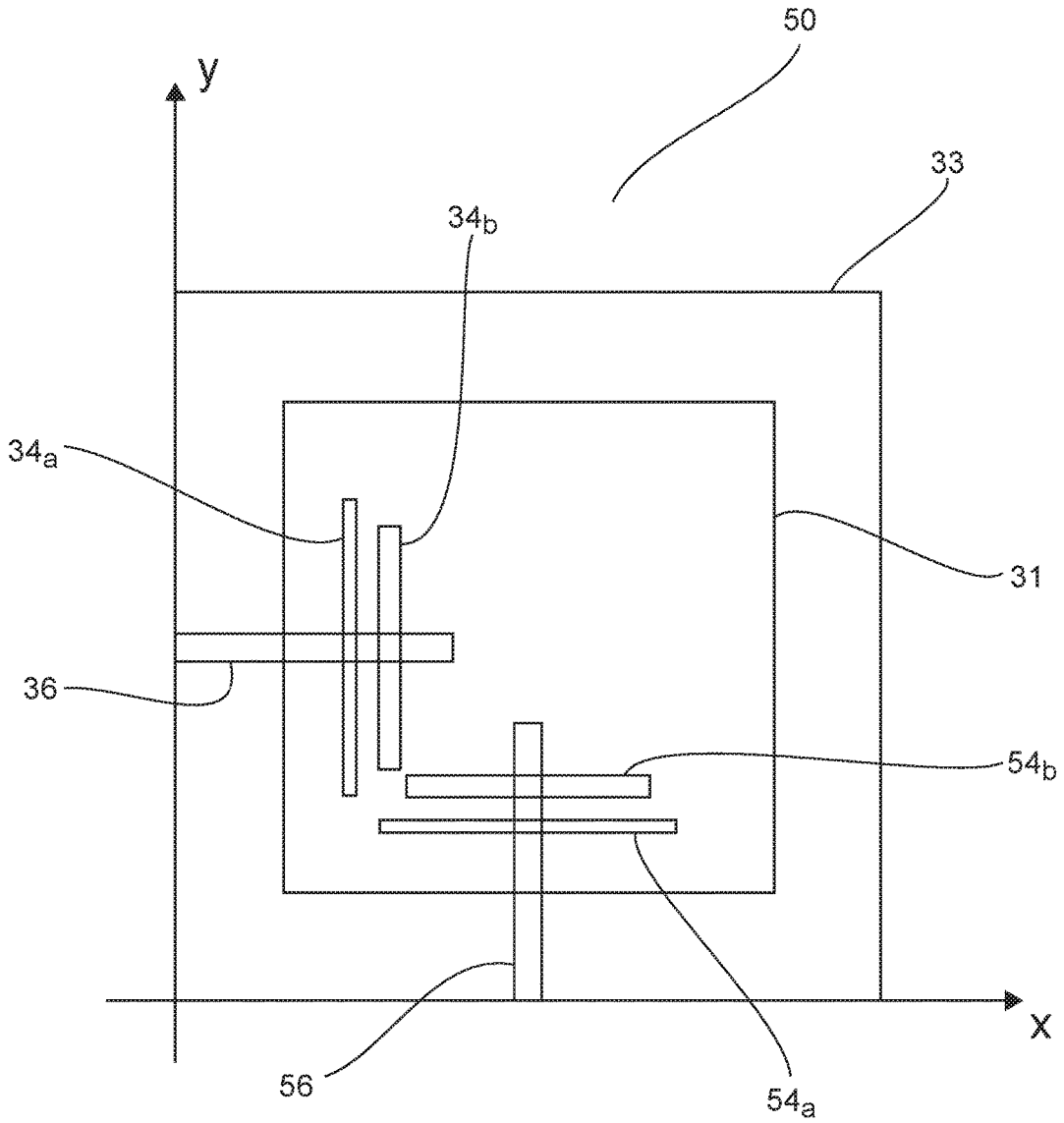
FIG. 5 is a top view presenting the structure of an antenna according to a second particular embodiment of the invention, working according to a circular polarization.

Referring now to FIG. 5, we present an antenna 50 according to a second particular embodiment of the invention, working according to a circular polarization, resulting from the combination of two orthogonal linear polarizations.

The antenna 50 comprises all the elements of the antenna 30 of FIGS. 3A, 3B, 4A and 4B (the transmission line 36 and the slots 34*a*, 34*b* being used for one of the two orthogonal linear polarizations).

The antenna 50 furthermore comprises another transmission line 56 and two other slots 54*a*, 54*b* (orthogonal to the slots 34*a*, 34*b*) which are used for the other of the two orthogonal linear polarizations.

Referring now to FIGS. 9 to 13, we present an antenna 90 according to a third particular embodiment of the invention, working according to a circular polarization.

Figure 9:
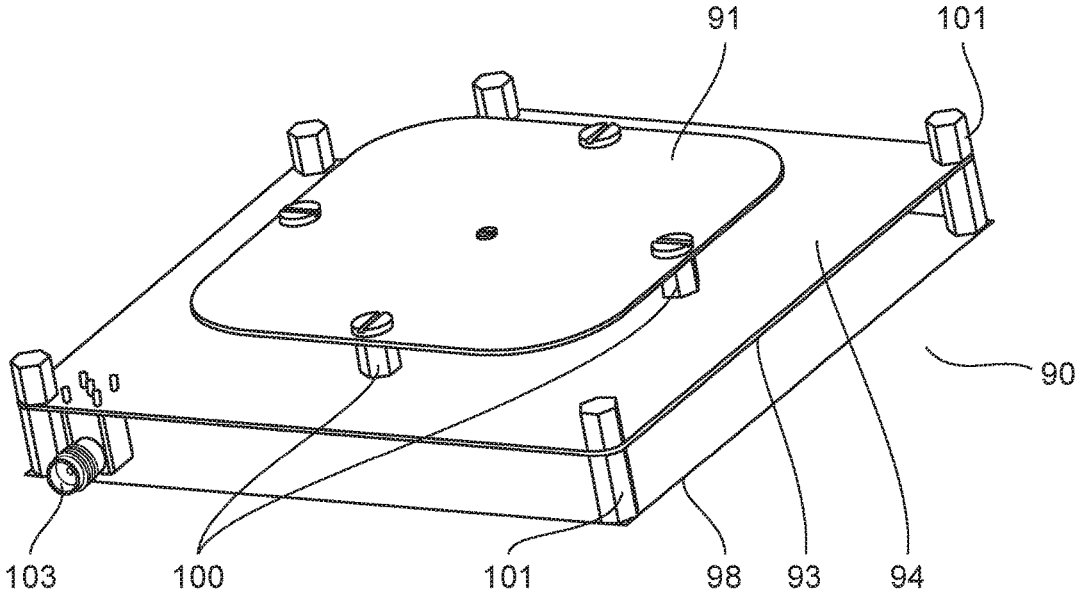
FIGS. 9 to 13 present the structure of an antenna according to a third particular embodiment of the invention, working according to a circular polarization.
Figure 10:
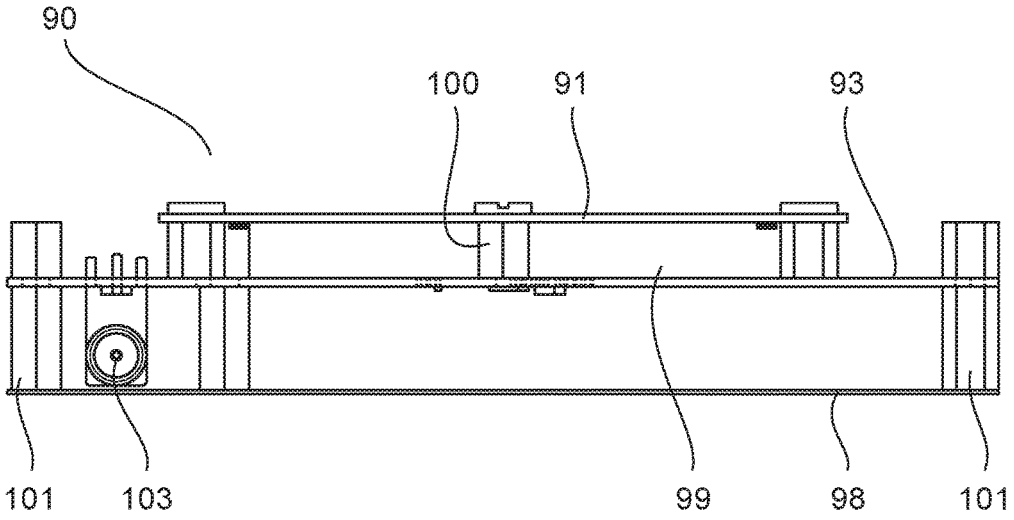

As illustrated in FIGS. 9 and 10 (a three-quarter view and a view in section respectively), the antenna 90 has a structure in which the following are superimposed respectively:

- a first dialectic substrate 91 (for example NELTEC NX9300) on the lower face of which there is printed a resonant patch 92 (cf. FIG. 11),
- a second dielectric substrate 93 (for example NELTEC NX9300) on the upper face of which there is printed a ground plane 94 comprising two pairs of slots (95*a*, 95*b*) and (96*a*, 96*b*) (cf. FIG. 12) and on the lower face of which there is printed a transmission line 97 (cf FIG. 13);
- a metal plate 98 forming a reflector plane (second ground plane).

The antenna 90 comprises a layer of air 99 (forming a dielectric layer) between the resonant patch 92 and the ground plane 94. To this end, the first and second dielectric substrates 91, 93 are separated by first metal spacers 100 (for example of 6 mm height).

The second dielectric substrate 93 and the metal plate 98 are separated by second metal spacers 101.

Figure 11:
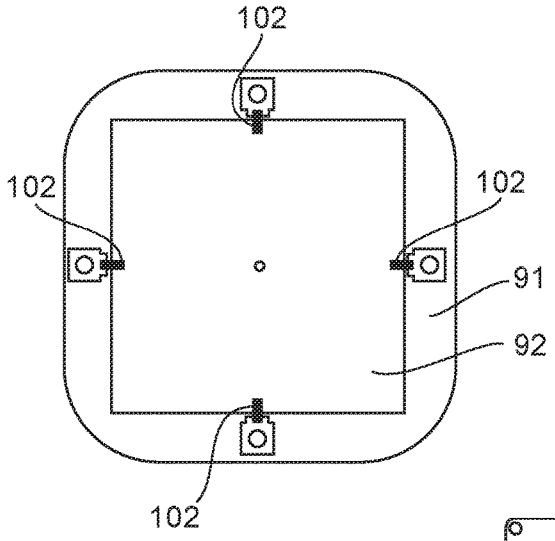

As illustrated in FIG. 11 (which is a view of the lower face of the first dielectric substrate 91), the antennas also comprise varicap diodes 102 (or any other variable capacitance element) each connected between a radiating side of the resonant patch 92 (in the middle of each ridge of the resonant patch 92) and the ground plane 93 (via the first metal spacers 100). The varicap diodes are powered by means of the resonant patch 92.

Figure 12:
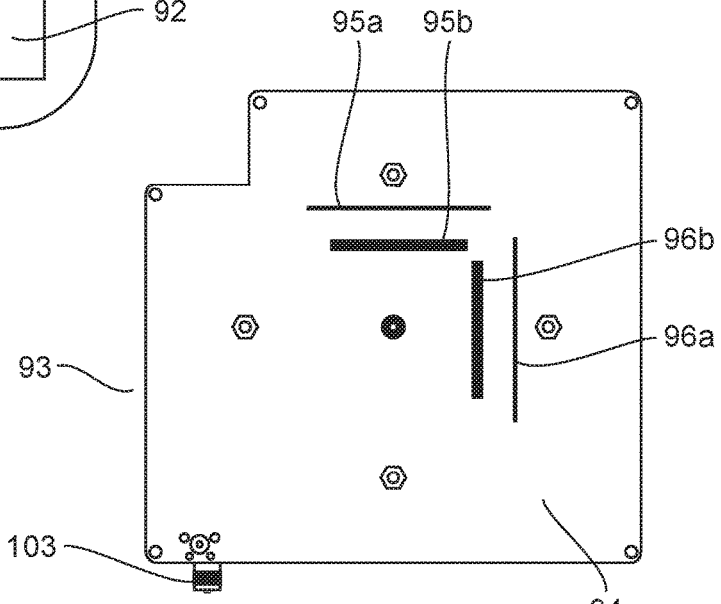

As illustrated in FIG. 12 (which is a view of the upper face of the second dielectric substrate 93), the two slots 95*a*, 95*b* have the same shape, namely a rectangular shape, and possess parallel longitudinal axes. Similarly, the two slots 96*a*, 96*b* have the same shape, namely a rectangular shape, and possess parallel longitudinal axes. The slots 95*a*, 95*b* are orthogonal to the slots 96*a*, 96*b*.

Figure 13:
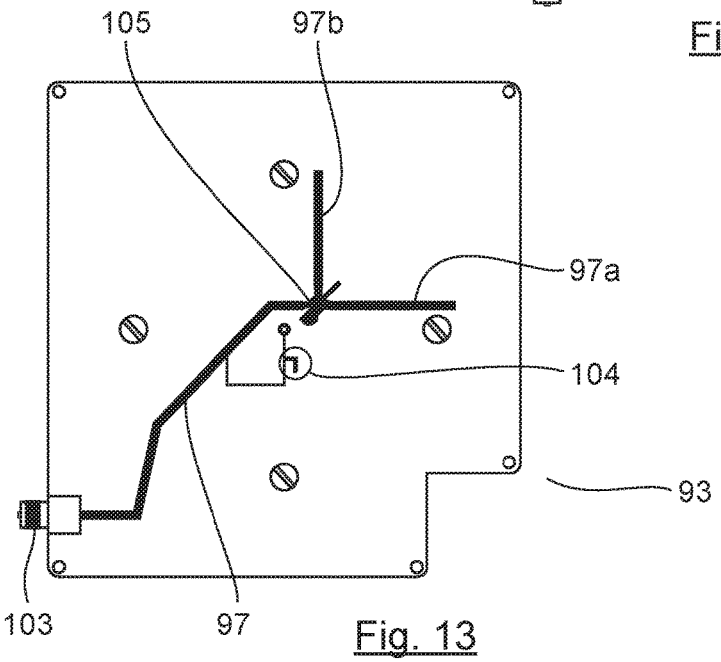

As illustrated in FIG. 13 (which is a view of the lower face of the second dielectric substrate 93), the transmission line 97 comprises a first end strand 97*a* extending beneath the pair of slots (95*a*, 95*b*) and a second end strand 97*b* extending beneath the pair of slots (96*a*, 96*b*). The antenna comprises a coupler 105 to combine the two orthogonal polarizations (in phase quadrature). The bias voltage of the varicap diodes 102 is for example sent by a port 103 and by the transmission line 97 (used also for the RF signals received by the antenna; in one variant, the bias voltage arrives on a separate port and is transmitted by a separate line). Then, it is conveyed to the resonant patch 92 via a polarization circuit 104 (DC block) so as not to disturb the HF signals. The first metal spacers 100 provide for a link between the ground of the diodes and the ground of the slots.

In one particular embodiment, the antenna 90 possesses the following dimensions (repeating the notations Oven further above for the antenna 30):

| | | | |
|---|---|---|---|
| $l_0$ = 105 mm ± 1 mm | $l_p$ = 55 mm ± 1 mm | $h_1$ = 0.8 mm ± 0.01 mm | $h_2$ = 6 mm ± 0.5 mm |
| $l_2$ = 30 mm ± 1 mm | $w_2$ = 2 mm ± 0.1 mm | $l_3$ = 40 mm ± 1 mm | $w_3$ = 1 mm ± 0.1 mm |
| $w_1$ = 2 mm ± 0.5 mm | $x_2$ = 34.5 mm ± 0.5 mm | $x_3$ = 26 mm ± 0.5 mm | $l_1$ = 30 mm ± 1 mm |

Figure 6:
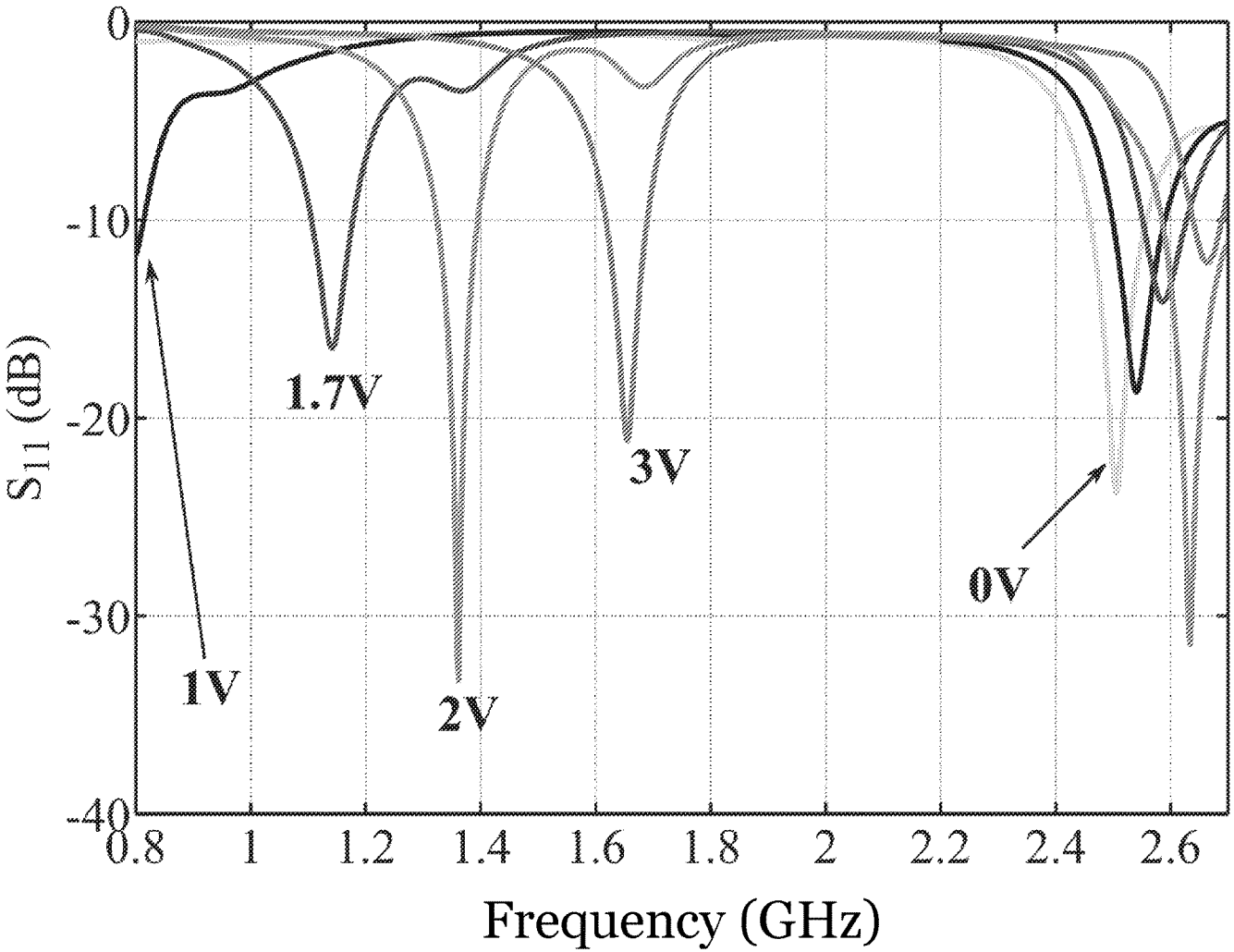
FIG. 6 illustrates the performance characteristics of a slot-fed and frequency-tunable planar antenna in one particular implementation of said third particular embodiment of the invention.

FIG. 6 illustrates the performance characteristics of the slot-fed and frequency-tunable planar antenna in a particular implementation of the third particular embodiment of the invention (that of FIGS. 9 to 13).

FIG. 6 presents five curves illustrating the variation of the reflection coefficient $S_{11}$ as a function of the frequency for different values of the bias voltage of the varicap diodes. Each curve corresponds to a distinct resonance and is obtained for one of the values of the bias voltage (1V, 1.7V, 2V, 3V and 0V). The matching of the antenna varies according to the bias voltages of the diode. The frequency of operation of the antenna varies between 1.1 GHz (for a bias voltage of 1.5V) and 2.5 GHz (for a bias voltage of 0V).

This antenna is therefore tunable over a wide band of frequencies (the GNSS band) with a low bias voltage, varying from 0V to 3V, which is compatible with the voltages available on portable devices. The consumption is extremely low since it relates for example to reverse-polarized varicap diodes.

The antennas are adapted to the reception of the signals from the different GNSS constellations in a band ranging from 1164 MHz to 2506 MHz (more than one octave), with a circular polarization and a directional radiation pattern. The solution therefore enables a use of a single antenna for the entire GNSS band which brings together all the satellite navigation systems, even the 2.5 GHz system and does so selectively.

The invention proposes a bandwidth of about 50 MHz (narrow band) tunable on a wider range of frequencies. The invention is therefore distinguished from rival approaches by:

- a coverage of the entire band dedicated to GNSS, even the 2.5 GHz band (IRNSS signals);
- very low consumption with a bias voltage that does not exceed 3V;
- selection of reception from a constellation by filtering out the other bands of the other constellations efficiently and naturally.

The dimensions of the two slots of a same pair (95*a*, 95*b*) or (96*a*, 96*b*) optimize the resonance frequency of the antenna according to the bias voltage. The originality here is the use of (at least) two slots to create two resonance values in the GNSS frequency band. These two resonance values cover all the frequency bands used for satellite localization applications.

Thus, in the example of FIG. 6, the antenna operates on the principle of covering a band around a 2.5 GHz with a bias voltage of 0V, and then a band of 1.1 GHz to 1.6 GHz with a bias voltage that varies between 1.5V and 3V. Operation in the 2.5 GHz band is provided by the slots 95*b*, 96*b*. The slots 95*a*, 96*a* provide for operation in the 1.1 to 1.6 GHz band.

In the GNSS frequency band (including the frequencies around 2.5 GHz), the antenna enables the selection of a sub-band (i.e. the reception band of a constellation) by efficiently and naturally filtering out the other sub-bands (i.e. the reception bands of the other constellations). In this way, the antenna plays the role of a natural filter for the unused frequency bands.

The present invention also relates to a satellite navigation receiver (GNSS receiver) enabling the reception and processing of the signals coming from the different satellite positioning systems and comprising or cooperating with an antenna according to this technique described and illustrated here above with different embodiments.

It is clear that many other embodiments of the invention can be envisaged. It is possible especially to envisage frequency bands other than the GNSS band, such as for example:

- the GSM 900 band (the GSM 900 band uses the 880-915 MHz band for sending voice and data from a cell phone and the 925-960 MHz band for receiving information coming from the network);
- the mobile telephony band (LTE+GSM+UMTS) which covers the 1.71-2.17 GHz band;
- the locating or transfer of data by WIFI at 2.4 GHz;
- the LTE band (4G) which covers the 2.5-2.7 GHz band for high bit-rate mobile telephony;
- discreet antennas for vehicles in the UHF band (the ultra-high frequency band (UHF) band is the band of the radio-electric spectrum ranging from 300 MHz to 3,000 MHz).

An exemplary embodiment of the present disclosure aims at overcoming the different drawbacks of the prior art.

An exemplary embodiment provides a slot-fed planar antenna that is frequency tunable on a wide band of frequencies while at the same time, requiring bias voltage that is lower than in present-day solutions, preferably below 3V.

An exemplary embodiment provides an antenna of this kind that covers the entire GNSS frequency band (including the frequencies around 2.5 GHz) with a small bias voltage compatible with the voltages available on portable devices.

An exemplary embodiment provides an antenna of this kind which, in the GNSS frequency band, enables the selection of the reception band of one constellation by efficiently and naturally filtering the reception bands of the other constellations.

An exemplary embodiment provides an antenna of this kind that costs little and is compact.

Although the present disclosure has been described with reference to one or more examples, workers skilled in the art will recognize that changes may be made in form and detail without departing from the scope of the disclosure and/or the appended claims.

The invention claimed is:

1. A frequency-tunable and slot-fed planar antenna comprising:

- a structure in which there are successively superimposed a resonant patch, a first dielectric layer, a ground plane comprising a first slot for each linear polarization, a second dielectric layer and a transmission line comprising, for each first slot, an end strand extending beneath said first slot, said antenna being frequency tunable for each linear polarization through at least one variable capacitance element connected between a radiating side of the resonant patch and the ground plane, wherein matching of said antenna varies for each linear polarization as a function of a bias voltage applied to said at least one variable capacitance element, for each linear polarization, at least one second slot extending along the first slot and having at least one dimension different from the first slot, said end strand of the transmission line extending beneath said first slot and said at least one second slot, said first slot creating a first resonance and said at least one second slot creating an additional resonance, and a frequency tunability resulting, for each linear polarization, from said first resonance for at least one first value of the bias voltage, and from said additional resonance for at least one second value of the bias voltage, for a first value of the bias voltage, the antenna covers a first sub-band resulting from the first resonance created by the first slot and, for a plurality of second successive values of the bias voltage, the antenna covers a plurality of second successive sub-bands distinct from the first sub-band, and each resulting from the additional resonance created by said at least one second slot, the first sub-band is around 2.5 GHz and the plurality of successive second sub-bands form a band ranging from 1.1 GHz to 1.6 GHz, the first value is 0V and the plurality of second successive values are between 1.5V to 3V.

2. The frequency-tunable and slot-fed planar antenna according to claim 1, wherein, for each linear polarization, said at least one second slot and said first slot are of the same shape.

3. The frequency-tunable and slot-fed planar antenna according to claim 2, wherein, for each linear polarization, said at least one second slot and said first slot possess parallel longitudinal axes.

4. The frequency-tunable and slot-fed planar antenna according to claim 1, wherein the resonant patch is square shaped with a side length $l_p$ equal to 55 mm ±1 mm, and, for each linear polarization:

said first slot is rectangular with a length $l_3$ equal to a 40 mm ±1 mm and a width $w_3$ equal to 1 mm ±0.1 mm; and said at least one second slot is rectangular, with a length $l_2$ equal to 30 mm ±1 mm and a width $w_2$ equal to 2 mm ±0.1 mm.

5. The frequency-tunable and slot-fed planar antenna according to claim 1, wherein the antenna works according to a single linear polarization.

6. The frequency-tunable and slot-fed planar antenna according to claim 1, wherein the antenna works according to first and second orthogonal linear polarizations, the combination of which gives a circular polarization, and the first slot and said at least one second slot for the first linear polarization are orthogonal respectively to the first slot and said at least one second slot for the second linear polarization.

7. A satellite positioning receiver enabling reception and processing of signals coming from different satellite positioning systems, comprising:

a frequency-tunable, over at least two frequency bands, and slot-fed planar antenna comprising:

a structure in which there are successively superimposed a resonant patch, a first dielectric layer, a ground plane comprising a first slot for each linear polarization, a second dielectric layer and a transmission line comprising, for each first slot, an end strand extending beneath said first slot, said antenna being frequency tunable for each linear polarization through at least one variable capacitance element connected between a radiating side of the resonant patch and the ground plane, wherein matching of said antenna varies for each linear polarization as a function of a bias voltage applied to said at least one variable capacitance element, for each linear polarization, at least one second slot extending along the first slot and having at least one dimension different from the first slot, said end strand of the transmission line extending beneath said first slot and said at least one second slot, said first slot creating a first resonance and said at least one second slot creating an additional resonance, and a frequency tunability resulting, for each linear polarization, from said first resonance for at least one first value of the bias voltage, and from said additional resonance for at least one second value of the bias voltage, for a first value of the bias voltage, the antenna covers a first sub-band resulting from the first resonance created by the first slot and, for a plurality of second successive values of the bias voltage, the antenna covers a plurality of second successive sub-bands distinct from the first sub-band, and each resulting from the additional resonance created by said at least one second slot, the first sub-band is around 2.5 GHz and the plurality of successive second sub-bands form a band ranging from 1.1 GHz to 1.6 GHz, the first value is 0V and the plurality of second successive values are between 1.5V to 3V.

* * * * *